US010526163B2

(12) United States Patent
Lohia

(10) Patent No.: US 10,526,163 B2
(45) Date of Patent: Jan. 7, 2020

(54) METHOD TO POSITION SPINDLE PRECISELY IN TURRET TYPE AUTOMATIC WINDER

(71) Applicant: Siddharth Lohia, Kanpur (IN)

(72) Inventor: Siddharth Lohia, Kanpur (IN)

( * ) Notice: Subject to any disclaimer, the term of this patent is extended or adjusted under 35 U.S.C. 154(b) by 36 days.

(21) Appl. No.: 15/767,352

(22) PCT Filed: Dec. 2, 2016

(86) PCT No.: PCT/IB2016/057287

§ 371 (c)(1),
(2) Date: Apr. 11, 2018

(87) PCT Pub. No.: WO2017/093950

PCT Pub. Date: Jun. 8, 2017

(65) Prior Publication Data

US 2018/0297809 A1 Oct. 18, 2018

(30) Foreign Application Priority Data

Dec. 3, 2015 (IN) ..... 1958/DEL/2015

(51) Int. Cl.
*B65H 67/048* (2006.01)
*B65H 54/52* (2006.01)

(52) U.S. Cl.
CPC ..... *B65H 67/048* (2013.01); *B65H 54/52* (2013.01); *B65H 2701/31* (2013.01)

(58) Field of Classification Search
CPC ... B65H 67/048; B65H 54/52; B65H 2701/31
See application file for complete search history.

(56) References Cited

U.S. PATENT DOCUMENTS 5,228,630 A 7/1993 Nakai et al.
5,407,143 A 4/1995 Nakai et al.

FOREIGN PATENT DOCUMENTS

DE 10303641 A1 * 11/2003 ..... B65H 54/46
WO WO-9842607 A1 * 10/1998 ..... B65H 54/52
WO WO-9918024 A1 * 4/1999 ..... B65H 54/70

* cited by examiner

*Primary Examiner* — William E Dondero
(74) *Attorney, Agent, or Firm* — Andrus Intellectual Property Law, LLP

(57) ABSTRACT

The invention relates to an automatic turret type yarn winding device. The automatic bobbin changeover process involves winding of yarn on a bobbin, followed by rotation of the turret to bring an empty bobbin into the winding position. Pressure rollers are provided to ensure consistent and accurate winding. The accurate relative positioning of the bobbins and pressure rollers is important. Wear and tear and particulate dust may cause malfunctioning of winder systems which may affect accuracy of turret rotations and relative positioning of the bobbins and pressure rollers, especially when the turret rotation during bobbin change-over stage is done in a single rotation. The invention provides a device and a method to position spindle precisely in turret type automatic winder, especially to identify correct stationing position of turret spindle after reverse movement post doffing. It involves, during the bobbin changeover process, the step of rotating the turret in at least two discrete rotational movements carried out at controlled speeds, whereby the empty bobbin assumes its accurate winding position.

13 Claims, 3 Drawing Sheets

Figure 2
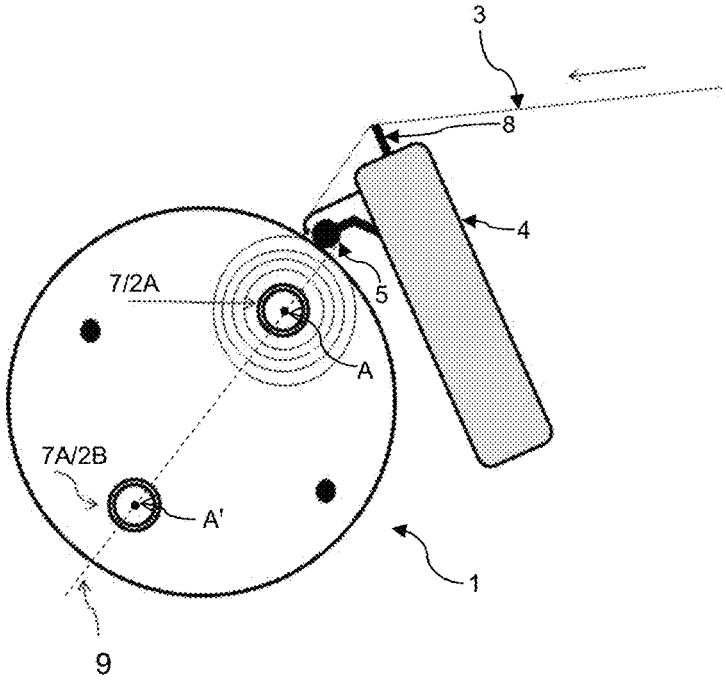
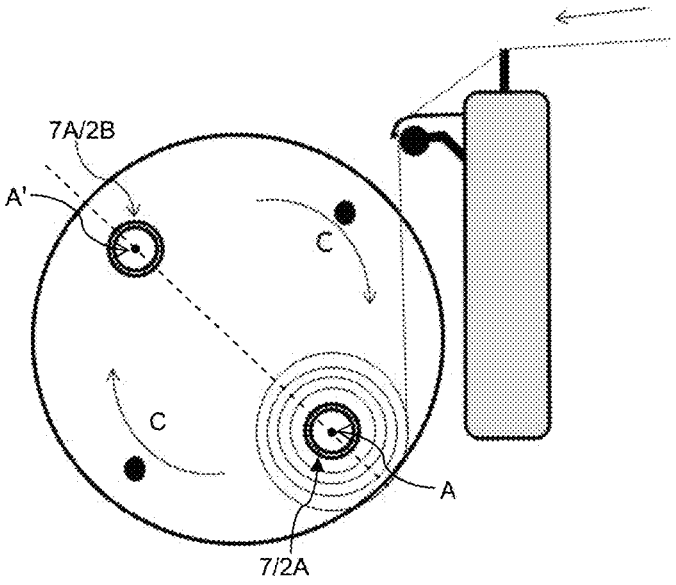
Figure 3

Figure 4
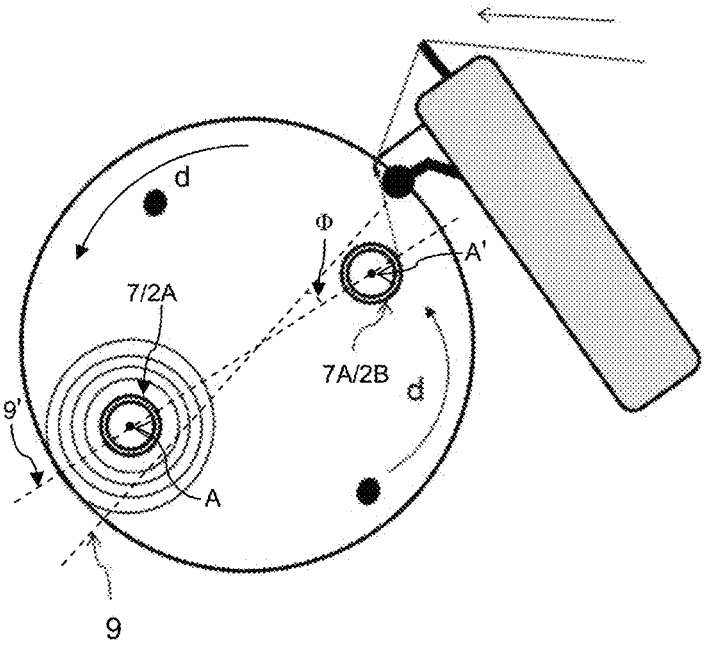
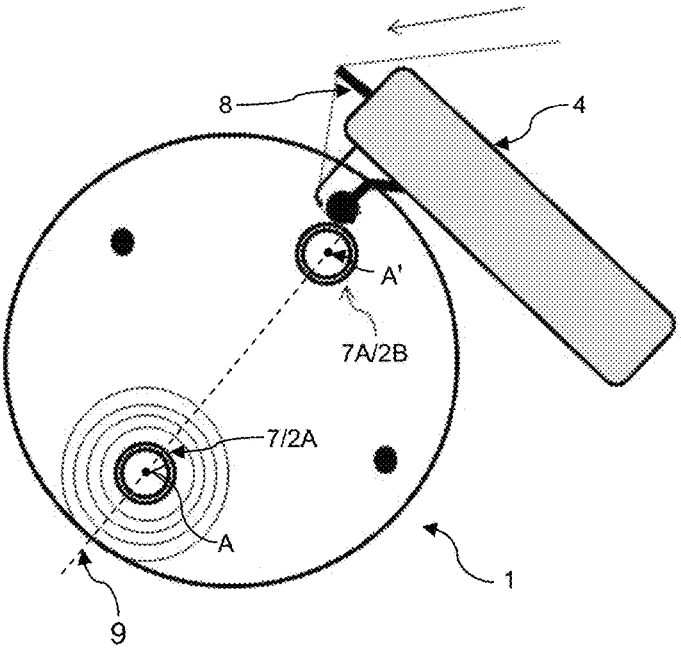
Figure 5

METHOD TO POSITION SPINDLE PRECISELY IN TURRET TYPE AUTOMATIC WINDER

FIELD OF INVENTION

The invention relates to an automatic yarn winding turret type device that can reliably and precisely position a spindle for winding after the bobbin changeover.

BACKGROUND OF INVENTION

The automatic turret type winder is used for winding of continuously arriving tapes, threads, or bands onto a bobbin. In general, on the turret type winder, a pair of bobbin holders—also known as spindles—are mounted on the opposite ends of a rotatable turret mounted on suitable machine frame. Each spindle is alternately displaced from the normal winding position to the doffing position by every half rotation of the turret. The turret keeps on rotating in the same direction at required time intervals. Each spindle needs precisely controlled rotation around its own axis, so may be driven independently by an electric motor through a suitable mechanism such as a belt and pulley arrangement or with an independent direct driving electrical motor system. Conventionally, the encoders or other suitable devices are mounted on the motor for monitoring the motor revolutions, and the signal is communicated to an electronic controller with the help of a suitable cable. The controller further sends the electrical signals to the inverter/drive of the active motor which determines the power to be given for the motor driving the spindle.

The conventional winders of the above type are disclosed in the U.S. Pat. Nos. 5,228,630, 4,765,552 and European Patent 861800A2. Other relevant inventions are disclosed in U.S. Pat. Nos. 5,228,630, 5,407,143, WO98/42607, WO99/18024, and DE10303641. These inventions, by and large, disclose methods and winders to transfer yarn on an empty bobbin in a continuous yarn winding operation. However, they do not teach how to position the empty bobbin with precision.

Automatic turret type winders were introduced for providing bobbins of polyolefin flat/fibrillated yams and to improve efficiency, reduce wastages. Automatic changeover process replaces spindle carrying yarn bobbin with the spindle carrying an empty bobbin.

In these conventional automatic winders, the turret is rotated by using a clutch and a pulley in synchronicity. Turret rotation is performed by releasing clutch and transferring the driving force to the pulley for rotation. After the turret rotation, correct positioning of empty bobbin is done by drifting bobbin in reverse direction towards the CAM box pressure roller. Ideally, spindle is positioned such that pressure roller should exert pressure uniformly on spindle present for winding. Reverse movement of turret carrying spindle is controlled according to the pre-set time and speed parameters in the control system. Practically, in conventional systems, turret movement is not uniform, and therefore not as smooth as required, due to change in mechanical condition. Machines of the type being discussed here are generally not operated under entirely dust-free environment. Therefore, as time progresses, accumulation of foreign particles on the mechanical components of the machinery increases even after taking abundant precaution to clean and maintain the machine. Accumulation of particulate matter provides hindrance to smooth motion of moving elements over a period of time. In other words, the system's resistance to smooth movement of components increases due to general wear and tear and accumulation of particulate matter.

For instance, a turret could become jammed due to accumulation of dust particles or may become tightened or loosened than required during maintenance cycle, leading to a turret rotation that is either faster or slower than desired or jerky. These mechanical glitches often result in improper spindle positioning relative to the pressure roller. Improper positioning causes a gap between the spindle bobbin which is ready to be wound and the pressure roller, which in turn produces uneven winding tension and therefore non-uniform package density.

Second, the stated problem in conventional winding system develops when the turret motion pushes the pressure roller extra in reverse direction. Similar to prior stated problem, this condition also produces variation in winding tension and formation of groves or undulations on the bobbin surface.

Therefore, there is a need to provide a method to position spindle precisely in turret type automatic winder automatic method, especially a method to identify correct stationing position of turret spindle after reverse movement post doffing.

There is also a need to provide a system that reduces possibility of turret positioning itself at an intermediate location, thereby leaving a gap between the spindle and the pressure roller, or positioning itself past its desired location, thereby exerting extra pressure on the roller.

OBJECTS OF THE INVENTION

Accordingly, it is an object of the present invention to provide a method to position spindle precisely in turret type automatic winder, especially method to identify correct stationing position of Turret spindle after reverse movement post doffing.

Another object of the present invention is to provide a system that reduces possibility of Turret positioning itself at an intermediate location, thereby leaving a gap between the spindle and the pressure roller, or positioning itself past its desired location, thereby exerting extra pressure on the roller.

LIST OF PARTS

| |
|---|
| Turret (1) |
| Spindle (2A) |
| Spindle (2B) |
| Tape (3) |
| CAM box (4) |
| Pressure Roller (5) |
| Tape Guide (6) |
| First and second bobbins (7, 7A) |
| Tensioning Bow (8) |
| Winding position line (9) |
| Close-by positional line (9') |

SUMMARY OF INVENTION

The invention relates to an automatic turret type yarn winding device. The automatic bobbin changeover process involves winding of yarn on a bobbin, followed by rotation of the turret to bring an empty bobbin into the winding position. Pressure rollers are provided to ensure consistent and accurate winding. The accurate relative positioning of the bobbins and pressure rollers is important. Wear and tear and particulate dust may cause malfunctioning of winder systems which may affect accuracy of turret rotations and relative positioning of the bobbins and pressure rollers, especially when the turret rotation during bobbin change-over stage is done in a single rotation. The invention provides a device and a method to position spindle precisely in turret type automatic winder, especially to identify correct stationing position of turret spindle after reverse movement post doffing. It involves, during the bobbin changeover process, the step of rotating the turret in at least two discrete rotational movements carried out at controlled speeds, whereby the empty bobbin assumes its accurate winding position.

BRIEF DESCRIPTION OF FIGURES

The objects and advantages of the invention may be understood by making reference to the following description, taken with the accompanying drawings:

FIG. 2 shows a schematic where the pre-set package size is reached;

FIG. 3 shows a schematic of the transitional movement of the turret during the bobbin changeover process;

FIG. 4 shows a schematic representing bobbin locations at the end of first rotational movement FIG. 5 shows a schematic of positioning of the turret and the bobbin at the final intended winding position

DETAILED DESCRIPTION OF THE INVENTION

The present invention discloses a method for precisely positioning the turret after the bobbin changeover.

Figure 1:
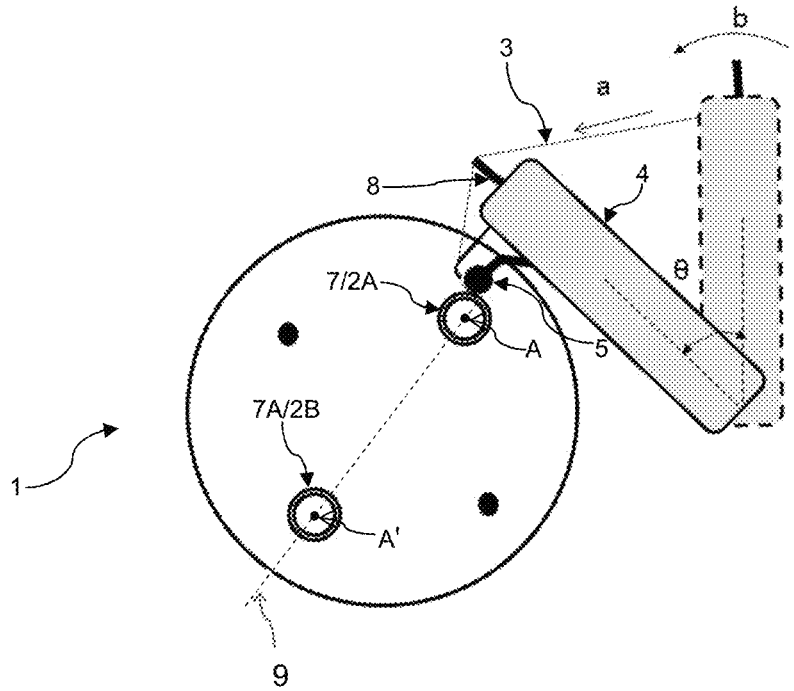
FIG. 1 shows a schematic of a turret with two spindles.
Figure 1A:
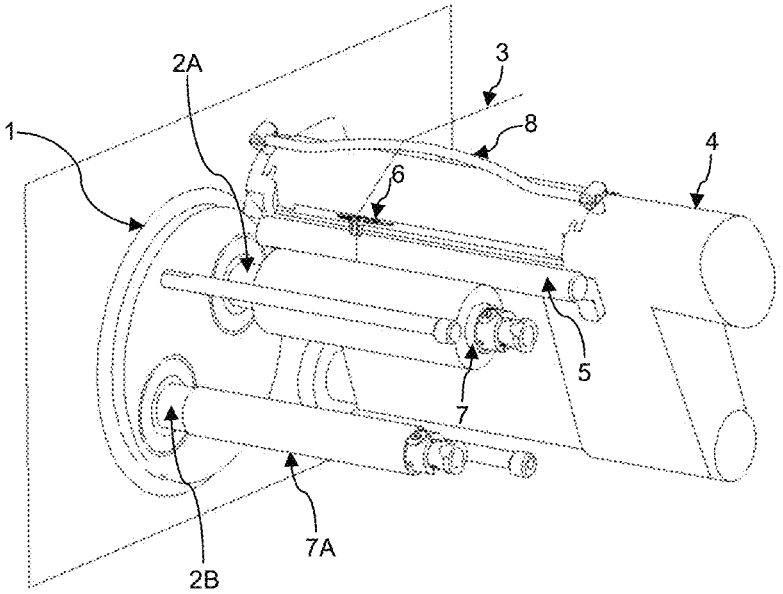
FIG. 1A shows a perspective view of a turret with two bobbins

FIG. 1 shows the present invention in an operational state. It shows a turret (1) at the start of a winding operation. It has empty first and second bobbins (7, 7A) mounted on two spindles (2A and 2B) with their centres respectively termed as points A and A', which fall on what is termed as a winding-position-line (9) or a bobbin positional axis/line, and where one of the two spindles (2A) is in a winding position to start winding. The position of the winding positioning line (9), which is an imaginary axis, is a position that is suitable for winding of yarn and will be known to a person skilled in the art. When the turret (1) is in this position, centres (A and A') of both bobbins (7, 7A) (presently empty) fall on the winding positional line (9) and one of the empty winding bobbins (7 or 7A) which is mounted on the spindles (2A or 2B) optimally touches the pressure roller (5). In this position, the pressure exerted by the first bobbin (7) which is in the winding position and the pressure roller (5) on each other is the optimal pressure for a given yarn (3), something a person skilled in the art would readily know.

In the description that follows, the terms spindles and bobbins are used interchangeably.

The tape (3) is delivered for winding after cutting and conditioning from tape line machine (not shown in figures) from direction 'a' (indicated as an arrow in FIG. 1) and after passing through a dancing arm (not shown in figures) which regulates tape tension. The tape line speed of discharging tapes (3) varies from 100 to 1000 meters per minute; the linear density of the tape material varies from 100 to 30000 denier.

Tape winding starts on the presently empty first bobbin (7) after a CAM box (4) bows down by an angle 'θ' (measured from the vertical) in the direction 'b' (indicated by a counterclock-wise arrow in FIG. 1). The magnitude of the angle is dependent on the turret geometry/design and would be known to a person skilled in the art. As the tape (3) winding progresses, the first bobbin (7) package diameter grows to a predetermined value. At this stage, a bobbin changeover is expected whereupon the common controller for the winder head instructs the motor of turret driving system (not shown in figures) to rotate for the bobbin changeover, such that the now empty second bobbin (7A) assumes the winding position.

FIG. 2 shows a position of the CAM box (4) where the preset first bobbin (7) diameter after winding of yarn has been achieved. As a part of the bobbin changeover process, the CAM box now rotates in a clockwise direction (i.e. a direction opposite to b) and the pressure roller (5) retracts from the wound first bobbin (7). A device that carries out the aforementioned rotation of the CAM box (4) may be an electromechanical, or a pneumatic or hydraulic system. Following the retractive rotation of the CAM box, the turret (1) begins to rotate in a direction indicated by arrow 'c' in FIG. 3, which shows the turret in a state of transitional movement.

At the end of the transitional movement, according to the invention, the turret reaches a position such that the now empty second bobbin (7A) which is mounted on the spindle (2B) reaches a position close to the winding position (FIG. 4). At the actual winding position, the centre (A') of the second bobbin (7A) should precisely be at the position previously occupied by the centre (A) of the now-filled first bobbin (7) at the start of its winding. However, according to the present invention, at the end of the transitional movement, the line joining the bobbin centres (A-A') achieved at the end of the transitional movement is not coincidental with the final position for winding represented by the winding positional line (9); actual position of the line joining centres of both bobbins (A-A') at the end of the transitional movement is deliberately drifted by an angle 'ϕ' (see FIG. 4), termed as the displacement angle, with respect to required winding positional line (9). In one aspect of the invention, the displacement angle (ϕ) may be up to 45°. The actual positional line joining the centres (A, A') of two bobbins (7, 7A) at the end of first rotational movement is termed as a close-by positional line (9'). If, as is the conventional manner, after winding of the operational first bobbin (7) is complete, turret (1) at the end of its transitional movement is rotated from its original winding position to its final position (so that the empty second bobbin (7A) is in a winding position) in a single continuous movement (as indicated by rotational direction arrow 'c'), then there is a strong possibility that the spindle needing to be wound would stop before or after the pressure roller location—but not at the precise desired location.

The present invention therefore proposes that the final position of the second bobbin (7A) is arrived at as a result of at least two discrete rotational movements. In the case where there are only two discrete rotational movements, the total rotational movement comprises a first and a second rotational movement. At the end of the transitional movement also termed as first rotational movement (indicated by arrow c in FIG. 3) for the purpose of this description, the empty second bobbin (7A) is intentionally stopped at the close-by position (9'). At the final intended winding position (9), the pressure roller leans on the empty second bobbin (7A) and exerts a gentle pressure on it before the winding can begin. The rotational speed of the first rotational movement depends on various parameters such as the yarn type and denier, line speed, winder designs in general, and would be known to a person skilled in the art.

The first rotational movement is followed by a second rotational movement (indicated by direction d in FIG. 4) in the direction required for the second bobbin (7A) to attain the final intended position, which takes place at a speed slower than the first rotational speed. As the second rotational movement continues and the second bobbin (7A) approaches its final winding position, and at some point touches the pressure roller (5) which may have already reached its predetermine location or in process of reaching it. At this point in time, the current in the turret motor starts to rise. The second rotational movement is stopped when the current in the motor reaches a predetermined value, indicating that the pressure roller (5) and the second bobbin (7A) are in the required final relative positions where the winding can begin. In some winding systems, the winding of the second bobbin (7A) may have already started before the pressure roller (5) and the second bobbin (7A) assume their required final relative positions.

As one aspect of the invention, the rotational speed (measured in RPM) of the second rotational movement may be up to 25% of the first rotational speed. This is done because controlling the movement at slow speeds to attain accurate final positioning of the second bobbin (7A) is far more feasible or achievable than trying to do so at high speed carried out in a single rotational movement. It is preferable, but not necessary, that the position of the second bobbin (7A) at the end of the first rotational movement is past the intended final position such that the directions c and d may be opposite to each other.

In another embodiment, the position achieved by the second bobbin (7A) at the end of the first rotational movement is before its final intended position. In this situation, the second rotational movement takes places in the same direction as the first rotational movement, i.e. the directions c and d may be same (i.e. both may be clockwise).

The final winding position of the second bobbin (7A) (see FIG. 5), is such that the second bobbin (7A) touches the pressure roller (5) at a position where tape tension does not vary much during winding process. In the preferred embodiment, the second bobbin (7A) reaches required position by rotating slightly in reverse direction 'd' (see FIG. 4). Typically, this reverse motion (d) is controlled by set parameters, however, sometimes due to the problems related to the mechanical adjustment of the parts facilitating the motion, the spindle does not reach the correct position. There is therefore a need to provide a procedure that will identify the exact position of the spindle.

The present invention synchronizes software logic and hardware such that when the second bobbin (7A) touches pressure roller (5), the current of motor driving the turret driving system increases; when driving motor current reaches above a pre-determined value, turret driving system sends a command to the motor of the turret drive system to stop and lock reached optimum position of the second bobbin (7A).

The invention can be also implemented by mounting strain gauge sensor on pressure roller supporting arms, such that, as pressure applied by the second bobbin (7A) on pressure roller (5) increases above set pressure limit the control logic of turret driving system stops and locks the final turret position.

Secondly, present invention invokes a method which can work precisely under low maintenance conditions.

It is apparent that the present invention has the following embodiments.

1. A method to position spindle precisely in turret type automatic winder, said winder incorporating a rotatable turret (1) driven by a motor, said motor being controlled by a turret driving system, on which turret (1) at least a first and a second bobbins (7, 7A) are mounted on respective spindles (2A, 2B) in a diametrically opposite position along a winding-positional-line (9), and wherein the first bobbin (7) is positioned in a position of winding a tape on it whereby, at the start of the tape winding process, said first bobbin (7) touches a pressure roller (5) provided on said winder, characterized in that said method comprises the step of, upon said first bobbin (7) reaching its predetermined package size, rotating the turret (1) in at least two discrete rotational movements carried out at controlled speeds, preferably two discrete rotational movements, wherein a first rotational movement is carried out at a controlled first rotational speed up to a point where the centres (A, A') of said bobbins (7, 7A) fall on a close-by positional line (9'), whereby said close-by positional line (9') and said winding positional line (9) are at a finite displacement angle (ϕ) with each other, followed by rotating said turret in a required direction at a controlled second rotational speed to carry out a second rotational movement, up to a point where said second bobbin (7A) touches said pressure roller (5), followed by triggering a stop-and-lock action to stop the rotation of said turret (1).
2. A method as disclosed in embodiment 1, characterized in that said second controlled speed is less than or equal to first controlled speed.
3. A method as disclosed in any of embodiments 1 to 2, characterized in said stop-and-lock action comprises the steps of
   increasing the current in said motor up to the predetermined value of said motor
   sending a command to said motor through said turret driving system, to stop the second rotational movement of said turret (1) upon attainment of said predetermined value of current and then lock said turret (1) at the position reached at the end of said second rotational movement.
4. A method as disclosed in any of embodiments 1 to 2, characterized in that characterized in said stop-and-lock action comprises the steps of
   increasing the threshold value of strain sensing device inbuilt with pressure roller
   sending a command to said motor through said turret driving system, to stop the second rotational movement of said turret (1) upon attainment of said predetermined value of strain and then lock said turret (1) at the position reached at the end of said second rotational movement.
5. A method as disclosed in any of embodiments 1 to 4, characterized in that said first movement is carried out so that said centre (A') of said second bobbin (7A) crosses over said winding-positional-line (9).
6. A method as disclosed in embodiment 5, characterized in that the direction of rotation of said second rotational movement is opposite to the direction of rotation of said first rotational movement.
7. A method as disclosed in embodiment 6, characterized in that the direction of rotation of said second rotational movement is same as the direction of rotation of said first rotational movement.

8. An apparatus to position spindle precisely in turret type automatic winder, said winder incorporating a rotatable turret driven by a motor, said motor being controlled by a driving system, on which turret at least a first and a second bobbins (7, 7A) are mounted on respective spindles (2A and 2B) in a diametrically opposite position along a winding-positional-line (9), and wherein the first bobbin (7) is positioned in a position of winding a tape on it whereby, at the start of the tape winding process, said first bobbin (7) touches a pressure roller (5) provided on said winder, characterized in that said apparatus is capable of, upon said first bobbin (7) reaching its predetermined package size, rotating the turret (1) in at least two discrete rotational movements carried out at controlled speeds, preferably two discrete rotational movements, wherein a first rotational movement is carried out at a controlled first rotational speed up to a point where the centres (A, A') of said bobbins (7, 7A) fall on a close-by positional line (9'), whereby said close-by positional line (9') and said winding positional line (9) are at a finite displacement angle (ϕ) with each other, followed by rotating said turret in a required direction at a second controlled speed to carry out a second rotational movement, up to a point where said second bobbin (7A) touches said pressure roller (5), followed by triggering a device to enable stop-and-lock action to stop the rotation of said turret (1).
9. An apparatus as disclosed in embodiment 8, characterized in that said second controlled speed less than or equal to first controlled speed.
10. An apparatus as disclosed in any of embodiments 8 to 9, characterized in that said device for enabling said stop-and-lock action increases the current in said motor up to the predetermined value of said motor.
11. An apparatus as disclosed in any of embodiments 8 to 10, characterized in that said device for enabling said stop-and-lock action increases the predetermined threshold value of said strain sensing device inbuilt with said pressure roller.
12. An apparatus as disclosed in any of embodiments 8 to 11, characterized in that said first movement is carried out so that said centre (A') of said second bobbin (7A) crosses over said winding-positional-line (9).
13. An apparatus as disclosed in any of embodiments 8 to 12, characterized in that the direction of rotation of said second rotational movement is opposite to the direction of rotation of said first rotational movement.
14. An apparatus as disclosed in embodiment 8 to 11, characterized in that the direction of rotation of said second rotational movement is same as the direction of rotation of said first rotational movement.
15. An apparatus disclosed in any of embodiments 8 to 14, characterized in that said device is capable of increasing the current in said motor up to the rated value of said motor, followed by the step of sending a command to said motor through said driving system, to stop the rotation of said turret (1) and lock said turret (1) in that position where it stops at the end of second rotational movement.
16. An apparatus as disclosed in any of embodiments 8 to 14, characterized in that said device comprises a strain gauge sensor mounted on pressure roller supporting arms, such that, as pressure applied by spindle on pressure roller (5) increases above set pressure limit the control logic of turret, said driving system stops and locks the final turret position.

While the above description contains much specificity, these should not be construed as limitation in the scope of the invention, but rather as an exemplification of the preferred embodiments thereof. It must be realized that modifications and variations are possible based on the disclosure given above without departing from the spirit and scope of the invention. Accordingly, the scope of the invention should be determined not by the embodiments illustrated, but by the appended claims and their legal equivalents.

I claim:

1. A method to position spindle precisely in turret type automatic winder, said winder incorporating a rotatable turret (1) driven by a motor, said motor being controlled by a turret driving system, on which turret (1) at least a first and a second bobbins (7, 7A) are mounted on respective spindles (2A, 2B) in a diametrically opposite position along a winding-positional-line (9), and wherein the first bobbin (7) is positioned in a position of winding a tape on it whereby, at the start of the tape winding process, said first bobbin (7) touches a pressure roller (5) provided on said winder, characterized in that said method comprises the step of, upon said first bobbin (7) reaching its predetermined package size, rotating the turret (1) in at least two discrete rotational movements carried out at controlled speeds, wherein a first rotational movement is carried out at a controlled first rotational speed up to a point where the centres (A, A') of said bobbins (7, 7A) fall on a close-by positional line (9'), whereby said close-by positional line (9') and said winding positional line (9) are at a finite displacement angle (ϕ) with each other, followed by rotating said turret in a required direction at a controlled second rotational speed to carry out a second rotational movement, up to a point where said second bobbin (7A) touches said pressure roller (5), followed by triggering a stop-and-lock action to stop the rotation of said turret (1), wherein said second controlled speed is less than or equal to first controlled speed, and wherein said stop-and-lock action comprises the steps of increasing the current in said motor up to the predetermined value of said motor sending a command to said motor through said turret driving system, to stop the second rotational movement of said turret (1) upon attainment of said predetermined value of current and then lock said turret (1) at the position reached at the end of said second rotational movement.

2. A method as claimed in claim 1, characterized in that said stop-and-lock action comprises the steps of increasing a threshold value of a strain sensing device inbuilt with said pressure roller (5)

sending a command to said motor through said turret driving system, to stop the second rotational movement of said turret (1) upon attainment of a predetermined value of strain and then lock said turret (1) at the position reached at the end of said second rotational movement.

3. A method as claimed in any of claims 1 to 2, characterized in that said first movement is carried out so that said centre (A') of said second bobbin (7A) crosses over said winding-positional-line (9).

4. A method as claimed in claim 3, characterized in that the direction of rotation of said second rotational movement is opposite to the direction of rotation of said first rotational movement.

5. A method as claimed in claim 4, characterized in that the direction of rotation of said second rotational movement is same as the direction of rotation of said first rotational movement.

6. An apparatus to position spindle precisely in turret type automatic winder, said winder incorporating a rotatable turret driven by a motor, said motor being controlled by a driving system, on which turret at least a first and a second bobbins (7, 7A) are mounted on respective spindles (2A and 2B) in a diametrically opposite position along a winding-positional-line (9), and wherein the first bobbin (7) is positioned in a position of winding a tape on it whereby, at the start of the tape winding process, said first bobbin (7) touches a pressure roller (5) provided on said winder, characterized in that said apparatus is capable of, upon said first bobbin (7) reaching its predetermined package size, rotating the turret (1) in at least two discrete rotational movements carried out at controlled speeds, wherein a first rotational movement is carried out at a controlled first rotational speed up to a point where the centres (A, A') of said bobbins (7, 7A) fall on a close-by positional line (9'), whereby said close-by positional line (9') and said winding positional line (9) are at a finite displacement angle (ϕ) with each other, followed by rotating said turret in a required direction at a second controlled speed to carry out a second rotational movement, up to a point where said second bobbin (7A) touches said pressure roller (5), followed by triggering a device to enable stop-and-lock action to stop the rotation of said turret (1), wherein said second controlled speed less than or equal to first controlled speed, and wherein said device for enabling said stop-and-lock action increases the current in said motor up to the predetermined value of said motor and subsequently sends a command to said motor through said driving system, to stop the rotation of said turret (1) and lock said turret (1) in that position where t stops at the end of second rotational movement.

7. An apparatus as claimed in claim 6, characterized in that, said device for enabling said stop-and-lock action has a strain sensing device inbuilt with said pressure roller (5), wherein said strain sensing device is mounted on pressure roller supporting arms, such that, as the pressure applied by spindle on said pressure roller (5) increases above a set pressure limit, the control logic of turret driving system stops and locks the final turret position.

8. An apparatus as claimed in any of claims 6 to 7, characterized in that said first movement is carried out so that said centre (A') of said second bobbin (7A) crosses over said winding-positional-line (9).

9. An apparatus as claimed in claim 8, characterized in that the direction of rotation of said second rotational movement is opposite to the direction of rotation of said first rotational movement.

10. An apparatus as claimed in claim 8, characterized in that the direction of rotation of said second rotational movement is same as the direction of rotation of said first rotational movement.

11. An apparatus as claimed in any of claims 6 to 7, characterized in that the direction of rotation of said second rotational movement is opposite to the direction of rotation of said first rotational movement.

12. An apparatus as claimed in any of claims 6 to 7, characterized in that the direction of rotation of said second rotational movement is same as the direction of rotation of said first rotational movement.

13. An apparatus as claimed in claim 6 characterized in that said device is capable of increasing the current in said motor up to the rated value of said motor.

* * * * *